US009888532B2

(12) United States Patent
Mishima

(10) Patent No.: US 9,888,532 B2
(45) Date of Patent: Feb. 6, 2018

(54) LIGHTING CIRCUIT AND ILLUMINATION SYSTEM

(71) Applicant: Panasonic Intellectual Property Management Co., Ltd., Osaka (JP)

(72) Inventor: Masanori Mishima, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 12 days.

(21) Appl. No.: 15/048,268

(22) Filed: Feb. 19, 2016

(65) Prior Publication Data

US 2016/0270170 A1 Sep. 15, 2016

(30) Foreign Application Priority Data

Mar. 12, 2015 (JP) ..... 2015-049894

(51) Int. Cl.
*H05B 33/08* (2006.01)

(52) U.S. Cl.
CPC ..... *H05B 33/0809* (2013.01); *H05B 33/0803* (2013.01)

(58) Field of Classification Search
CPC ..... H05B 33/0815; H05B 33/0845; H05B 33/0839; H05B 33/0848; H05B 33/0866
USPC ..... 315/192, 196, 251, 291, 307–308
See application file for complete search history.

(56) References Cited

U.S. PATENT DOCUMENTS 6,472,688 B2 10/2002 Miyata
8,564,210 B2 10/2013 Hamamoto et al.
2001/0020705 A1 9/2001 Miyata
2011/0210675 A1 9/2011 Hamamoto et al.
2012/0062122 A1* 3/2012 Xi ..... H05B 33/0887 315/120
2013/0009560 A1* 1/2013 Takeda ..... H05B 33/0818 315/201

FOREIGN PATENT DOCUMENTS

JP 2001-244506 A 9/2001
JP 2011-181295 A 9/2011
JP 2012-094811 A 5/2012
JP 2013-004370 A 1/2013

* cited by examiner

*Primary Examiner* — Douglas W Owens
*Assistant Examiner* — Henry Luong
(74) *Attorney, Agent, or Firm* — Renner, Otto, Boisselle & Sklar, LLP

(57) ABSTRACT

A lighting circuit which supplies current to a solid-state light-emitting element module (LED module) including: a solid-state light-emitting element (LED); a first input terminal connected to one end of the solid-state light-emitting element; a second input terminal connected to another end of the solid-state light-emitting element; and a rectifying element (diode) connected in inverse-parallel connection with the solid-state light-emitting element, includes; a power supplier that supplies current to the solid-state light-emitting element module selectively in one of a forward direction and a reverse direction of the solid-state light-emitting element; a voltage detector circuit that detects voltage that is applied between the first input terminal and the second input terminal, when the power supplier supplies current in the reverse direction of the solid-state light-emitting element; and a control circuit that controls an output current of the power supplier based on the result of the detection by the voltage detector circuit.

6 Claims, 6 Drawing Sheets

LIGHTING CIRCUIT AND ILLUMINATION SYSTEM

CROSS REFERENCE TO RELATED APPLICATION

This application claims the benefit of priority of Japanese Patent Application Number 2015-049894 filed on Mar. 12, 2015, the entire content of which is hereby incorporated by reference.

BACKGROUND OF THE INVENTION

1. Field of the Invention

The present disclosure relates to a lighting circuit which supplies current to a solid-state light-emitting element module including a solid-state light-emitting element such as an LED (light-emitting diode), and to an illumination system including the lighting circuit.

2. Description of the Related Art

A lighting circuit which supplies current to a solid-state light-emitting element module including a solid-state light-emitting element such as an LED is conventionally known (for example, PTL (Patent Literature) 1: Japanese Unexamined Patent Application Publication No. 2011-181295 and PTL 2: Japanese Unexamined Patent Application Publication No. 2013-004370). In the techniques disclosed in PTL 1 and PTL 2, the solid-state light-emitting element module is so configured as to be removably attached to the lighting circuit. In a situation such as where the solid-state light-emitting element module is damaged, this configuration allows only the solid-state light-emitting element module to be replaced.

SUMMARY OF THE INVENTION

Furthermore, PTL 1 discloses a configuration of a solid-state light-emitting element module that includes a connection terminal for outputting characteristics setting signals in order that a plurality of solid-state light-emitting element modules having different electrical characteristics are available with a single lighting circuit. With this, the lighting circuit disclosed in PTL 1 outputs, based on the characteristics setting signals, current adapted to the electrical characteristics of the solid-state light-emitting element modules.

However, the lighting circuit disclosed in PTL 1 requires a terminal to which the characteristics setting signals are input, and therefore has a complicated circuit configuration.

In PTL 2, in order to make available a plurality of solid-state light-emitting element modules having different electrical characteristics with a single lighting circuit, a resistor or the like for identifying electrical characteristics of a solid-state light-emitting element included in the solid-state light-emitting element module is connected in parallel with the solid-state light-emitting element. The lighting circuit detects voltage that is applied when the resistor or the like is supplied with current, thereby identifying the electrical characteristics of the solid-state light-emitting element module. Therefore, the lighting circuit disclosed in PTL 2 outputs current adapted to the electrical characteristics of the solid-state light-emitting element module.

However, with the lighting circuit disclosed in PTL 2, there is a power loss because the current also flows through the above-stated resistor constantly when the lighting circuit causes the solid-state light-emitting element module to emit light. In order to reduce the power loss, PTL 2 discloses the configuration in which a switching element is connected in series with the above-stated resistor and remains in OFF state except when the electrical characteristics of the solid-state light-emitting element module are identified. However, with this configuration in which the switching element is connected, the solid-state light-emitting element module has a complicated configuration.

An object of the present disclosure is to provide a lighting circuit that is capable of supplying current adapted to electrical characteristics of a solid-state light-emitting element module and has a simplified circuit configuration and high efficiency, and to provide an illumination system including the lighting circuit.

In order to achieve the aforementioned object, a lighting circuit according to one aspect of the present disclosure is a lighting circuit which supplies current to a solid-state light-emitting element module including: a solid-state light-emitting element; a first input terminal connected to one end of the solid-state light-emitting element; a second input terminal connected to another end of the solid-state light-emitting element; and a rectifying element connected in inverse-parallel connection with the solid-state light-emitting element between the first input terminal and the second input terminal, and the lighting circuit includes: a power supplier that supplies current between the first input terminal and the second input terminal of the solid-state light-emitting element module selectively in one of a forward direction and a reverse direction of the solid-state light-emitting element; a voltage detector circuit that detects voltage that is applied between the first input terminal and the second input terminal, when the power supplier supplies current between the first input terminal and the second input terminal in the reverse direction of the solid-state light-emitting element; and a control circuit that controls, based on a result of the detection by the voltage detector circuit, supply of current from the power supplier to the solid-state light-emitting element module.

According to the present disclosure, it is possible to provide a lighting circuit that is capable of supplying current adapted to electrical characteristics of a solid-state light-emitting element module and has a simplified circuit configuration and high efficiency, and to provide an illumination system including the lighting circuit.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

Hereinafter, exemplary embodiments are described with reference to the accompanying drawings. Note that each of the embodiments described below shows a preferred specific example of the present disclosure. Therefore, the numerical values, shapes, materials, structural elements, arrangement and connection of the structural elements, steps, the processing order of the steps etc., shown in the following embodiments are mere examples, and are not intended to limit the present disclosure. Consequently, among the structural elements in the following embodiments, structural elements not recited in any one of the independent claims which indicate the broadest concepts of the present disclosure are described as arbitrary structural elements.

Note that the respective figures are schematic diagrams and are not necessarily precise illustrations. Additionally, substantially the same structural elements in the figures share the same reference signs, and description that would overlap may be omitted or simplified.

Embodiment 1

1:1. Configuration of Illumination System

First, a configuration of an illumination system according to Embodiment 1 is described with reference to the drawings.

Figure 1:
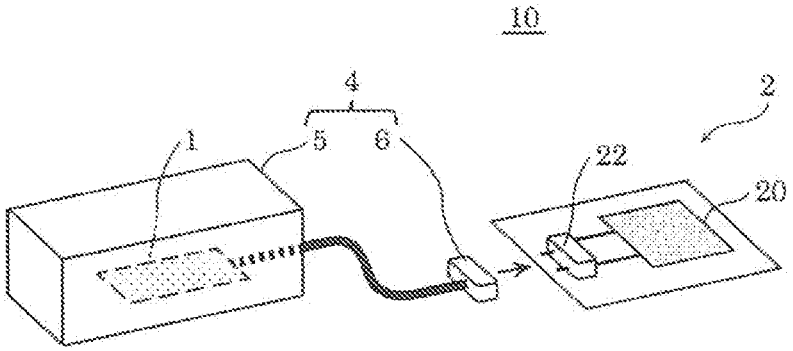
FIG. 1 is an external perspective view schematically illustrating illumination system according to Embodiment 1.

FIG. 1 is an external perspective view schematically illustrating illumination system 10 according to this embodiment.

Figure 2:
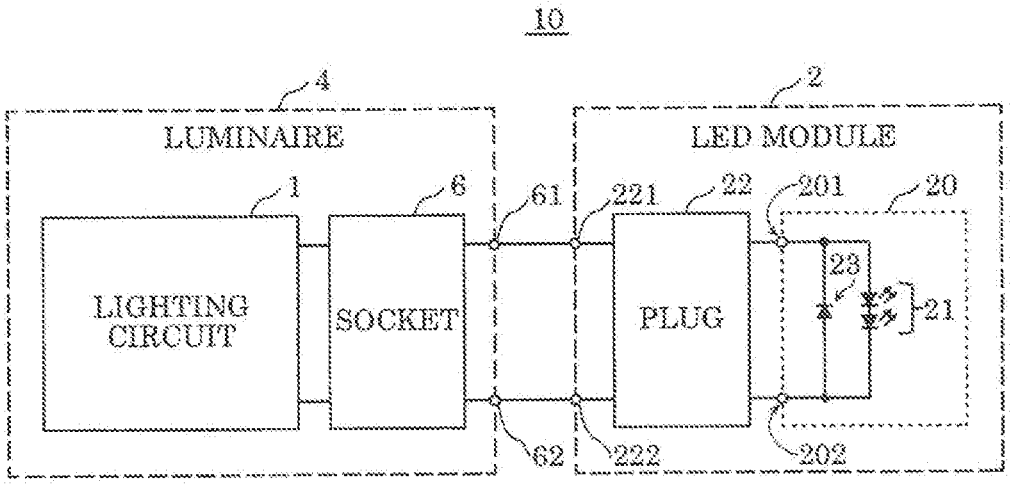
FIG. 2 is a schematic circuit diagram of an illumination system according to Embodiment 1.

FIG. 2 is a schematic circuit diagram of illumination system 10 according to this embodiment.

As illustrated in FIG. 1, illumination system 10 includes luminaire 4 and LED module 2.

Luminaire 4 is a device for supplying current to LED module 2, and includes power supply box 5 including lighting circuit 1, and socket 6.

LED module 2 is a solid-state light-emitting element module that emits light when supplied with current from luminaire 4. As illustrated in FIG. 2, LED module 2 includes LED 21, first input terminal 221 connected to one end of LED 21, and second input terminal 222 connected to the other end of LED 21. In addition, LED module 2 further includes diode 23 connected in inverse-parallel connection with LED 21, between first input terminal 221 and second input terminal 222. In this embodiment, LED module 2 includes plug 22 which is connected to socket 6 of luminaire 4, and light source 20 having LED 21.

Lighting circuit 1 supplies current to LED module 2. Details of lighting circuit 1 are described later.

Socket 6 is a coupling part structured so as to be removably attached to plug 22 of LED module 2, and includes first socket terminal 61 and second socket terminal 62. Socket 6 is connected to lighting circuit 1, and an output current of lighting circuit 1 is supplied to LED module 2 via socket 6. The shape, structure, etc., of socket 6 are not particularly limited as long as they are adapted to plug 22.

Plug 22 is a coupling part structured so as to be removably attached to socket 6 of luminaire 4, and includes first input terminal 221 and second input terminal 222. Furthermore, plug 22 is connected to light source 20, and current input from luminaire 4 to LED module 2 is supplied to light source 20 via plug 22. The shape, structure, etc., of plug 22 are not particularly limited as long as they are adapted to socket 6.

First input terminal 221 is one of the terminals of plug 22, and is connected to an anode-side end of LED 21 and a cathode-side end of diode 23.

Second input terminal 222 is one of the terminals of plug 22, and is connected to a cathode-side end of LED 21 and an anode-side end of diode 23.

First input terminal 221 and second input terminal 222 are connected to first socket terminal 61 and second socket terminal 62 of socket 6, respectively.

Light source 20 is one example of a light source of LED module 2, and includes LED 21, diode 23, first connection terminal 201, second connection terminal 202, and a substrate (not illustrated in the drawings) on which these parts are provided. In this embodiment, the substrate is formed of a planar substrate.

LED 21 is a solid-state light-emitting element that is used as a light emitter of LED module 2. LED 21 is formed of a SMD (surface mount device) LED element, for example. Furthermore, LED 21 includes one or more LED elements.

Diode 23 is a rectifying element connected in inverse-parallel connection with LED 21, between first input terminal 221 and second input terminal 222. Diode 23 is used for identifying electrical characteristics of LED module 2. In this embodiment, the electrical characteristics of diode 23 correspond to the electrical characteristics of LED module 2. An example of the electrical characteristics of diode 23 corresponding to the electrical characteristics of LED module 2 is a forward voltage. The forward voltage of diode 23 is approximately 0.6 V, for example. Note that diode 23 may be formed of a single diode or may include a plurality of diodes connected in series or in parallel. Moreover, diode 23 has a function of conducing when a reverse bias voltage is applied to LED 21, to reduce the occurrence of an excessively high reverse bias voltage being applied to LED 21.

First connection terminal 201 is connected to the anode-side end of LED 21 and the cathode-side end of diode 23. Connection terminal 201 is connected to first socket terminal 61 of luminaire 4 via plug 22.

Second connection terminal 202 is connected to the cathode-side end of LED 21 and the anode-side end of diode 23. Second connection terminal 202 is connected to second Socket terminal 62 of luminaire 4 via plug 22.

Lighting circuit 1 according to this embodiment identifies the electrical characteristics of LED module 2 based on the configuration of an element such as diode 23 connected in inverse-parallel connection with LED 21. Next, another example of the configuration of light source 20 in LED module 2 illustrated in FIG. 2 is described with reference to the drawings.

Figure 3A:
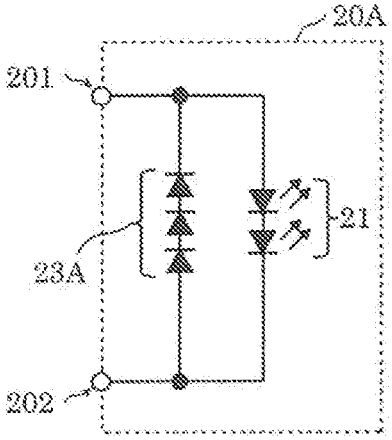
FIG. 3A is a circuit diagram illustrating one example of a light source according to Embodiment 1.

FIG. 3A is a circuit diagram illustrating light source 20A according to this embodiment.

Figure 3B:
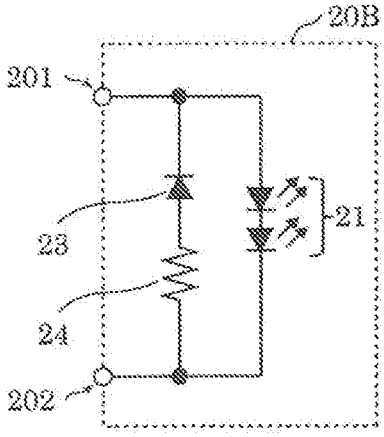
FIG. 3B is a circuit diagram illustrating another example of a light source according to Embodiment 1.

FIG. 3B is a circuit diagram illustrating source 20B according to this embodiment.

Light source 20A is one example of the light source according to this embodiment. As illustrated in FIG. 3A, light source 20A is different from light source 20 described above, in terms of the configuration of diode 23A.

Diode 23A is a rectifying element including a plurality of diodes connected in series, and has a higher forward voltage than diode 23 included in light source 20. For example, diode 23A has a configuration in which three diodes 23 are connected in series. The forward voltage of diode 23A is approximately 1.8 V, for example.

For example, in order to identify light source 20 illustrated in FIG. 2 and light source 20A, it is sufficient that voltage applied between first connection terminal 201 and second connection terminal 202 is detected in a state where current flows as a result of a reverse bias for LED 21 being applied, between first connection terminal 201 and second connection terminal 202. Since this voltage is equivalent to the forward voltage of diode 23 or diode 23A, it is possible to identify light source 20 and light source 20A based on the forward voltage. Note that although diode 23A includes the plurality of diodes connected in series, the configuration of diode 23A is not limited, to this example. For example, diode 23A may be formed of a single diode having a high forward voltage.

Light source 20B is another example of the light source according to this embodiment. As illustrated in FIG. 3B, light source 20B is different from light source 20 described above in that resistor 24 is connected in series with diode 23.

For example, in order to identify light source 20 illustrated in FIG. 2 and light source 20B, it is sufficient that voltage applied between first connection terminal 201 and second connection terminal 202 is detected, as in the case of identifying light source 20 and light source 20A. This voltage is equivalent to the forward voltage of diode 23 or a sum of the forward voltage and voltage applied to resistor 24. Accordingly, it is possible to identify light source 20 and light source 20B based on the voltage applied between first connection terminal 201 and second connection terminal 202.

1-2. Configuration of Lighting Circuit

Next, a configuration of lighting circuit 1 according to this embodiment is described with reference to the drawings.

Figure 4:
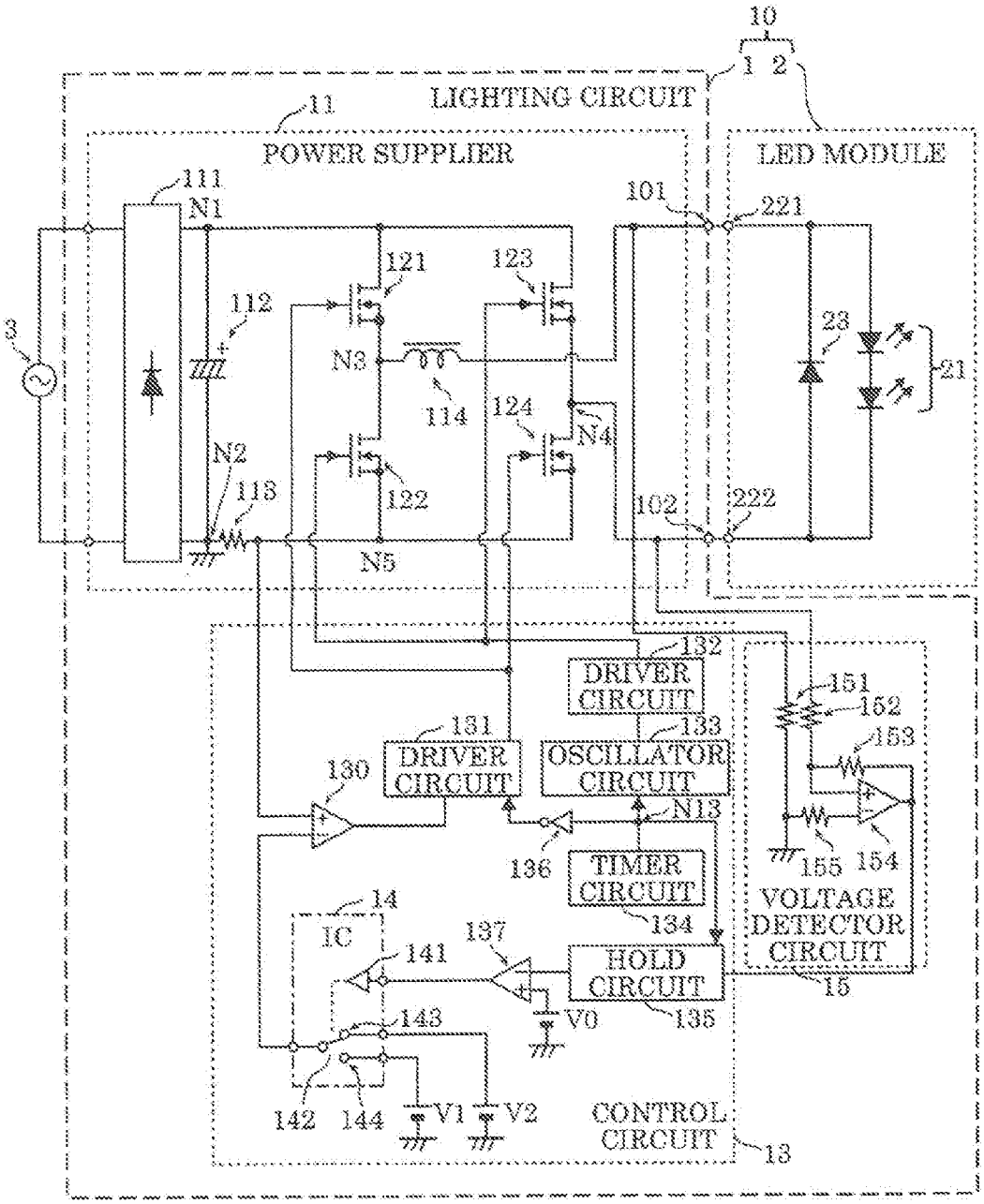
FIG. 4 is a circuit diagram illustrating a configuration of a lighting circuit according to Embodiment 1.

FIG. 4 is a circuit diagram illustrating a configuration of lighting circuit 1 according to this embodiment. FIG. 4 illustrates lighting circuit 1, illumination system 10 including lighting circuit 1, and AC (alternating current) power supply 3 which supplies AC voltage to lighting circuit 1.

AC power supply 3 outputs AC voltage and is a system power supply such as a commercial power supply which outputs AC voltage of 100 V to 242 V, for example.

As illustrated in FIG. 4, lighting circuit 1 includes power supplier 11, control circuit 13, and voltage detector circuit 15. Furthermore, lighting circuit 1 includes first output terminal 101 and second output terminal 102.

First output terminal. 101 and second output terminal 102 are terminals from which current is output to LED module 2 and that are respectively electrically connected to first input terminal 221 and second input terminal 222 of LED module 2.

Power supplier 11 is a circuit that supplies current between first input terminal 221 and second input terminal. 222 of LED module 2 selectively in one of a forward direction and a reverse direction of LED 21. In this embodiment, power supplier 11 converts to DC (direct-current) voltage AC voltage input from AC power supply 3, and additionally performs DC-to-DC conversion, thereby generating constant DC. The direction and value of this constant DC are controlled by control circuit 13. As illustrated in FIG. 4, power supplier 11 includes rectifier 111, capacitor 112, resistor 113, inductor 114, and switching elements 121, 122, 123, and 124.

Rectifier 111 is a circuit that rectifies AC voltage input from AC power supply 3. Rectifier 111 includes a diode bridge, for example.

Capacitor 112 is an element for smoothing pulsing DC voltage output from rectifier 111. Capacitor 112 has one end connected at node N1 to a high-voltage output terminal of rectifier 111 and the other end connected at node N2 to a low-voltage output terminal of rectifier 111. In this embodiment, capacitor 112 is formed of an electrolytic capacitor.

Resistor 113 is a sense resistor for detecting current that flows to LED 21, that is, an output current of power supplier 11. Resistor 113 has one end connected at node N2 to the low-voltage output terminal of rectifier 111 and the other end connected to node N5.

Inductor 114 is a choke coil, and stores and releases energy according to a switching operation of each of the switching elements. Inductor 114 has one end connected to node N3 and the other end connected to first output terminal 101.

Switching elements 121, 122, 123, and 124 perform switching (repeat turning ON and OFF) under control of control circuit 13. In this embodiment, each of the switching elements is an N-channel (MOSFET) metal-oxide semiconductor field-effect transistor connected in series with inductor 114. A series circuit including switching elements 121 and 122 and a series circuit including switching elements 123 and 124 are connected in parallel. This means that switching elements 121, 122, 123, and 124 form a full-bridge circuit. Each of drain electrodes of switching elements 121 and 123 is connected to node N1, and each of source electrodes of switching elements 122 and 124 is connected to node N5. Node N3 which is a connection point between switching element 121 and switching element 122 is connected to first output terminal 101 via inductor 114. Node N4 which is a connection point between switching element 123 and switching element 124 is connected to second output terminal 102. With the above-described configurations of the switching elements and inductor 114, it is possible for control circuit 13 to control the direction and value of current which power supplier 11 outputs. An operation performed by power supplier 11 will be described later in detail.

Voltage detector circuit 15 detects voltage that is applied between first output terminal 101 and second output terminal 102, that is, voltage that is applied between first input terminal 221 and second input terminal 222 of LED module 2. With this, it is possible to detect voltage that is applied across diode 23 of LED module 2 (i.e., the forward voltage of diode 23). In this embodiment, voltage detector circuit 15 includes resistors 151, 152, 153, and 155, and operational amplifier 154, and functions as a differential amplifier circuit. Voltage detector circuit 15 generates at an output terminal of operational amplifier 154 voltage corresponding to the voltage that is applied across diode 23. Assuming that resistors 152 and 153 have respective resistance values $R_{152}$ and $R_{153}$, the differential amplifier circuit generates at the output terminal of operational amplifier 154 voltage that is $R_{152}/R_{153}$ times as high as the voltage that is applied across diode 23. In this embodiment, the resistance values of resistors 152 and 153 are set so that $R_{152}/R_{153}$ is nearly 1. To put it differently, voltage detector circuit 15 outputs almost the same voltage as the voltage that is applied across diode 23. Furthermore, voltage detector circuit 15 outputs the detected voltage to hold circuit 135 of control circuit 13.

Control circuit 13 controls, based on the result of the detection by voltage detector circuit 15, supply of current from power supplier 11 to LED module 2. More specifically, control circuit 13 controls the direction and value of current which power supplier 11 outputs by controlling the switching elements of power supplier 11. Control circuit 13 includes comparator 130, driver circuits 131 and 132, oscillator circuit 133, timer circuit 134, hold circuit 135, NOT circuit 136, comparator 137, and IC (integrated circuit) 14.

Timer circuit 134 switches an operation mode of lighting circuit 1 between a detection mode and a lighting mode. The detection mode is a mode of detecting voltage that is applied between first output terminal 101 and second output terminal 102. The lighting mode is a mode of lighting LED module 2. Timer circuit 134 outputs a signal for lighting circuit 1 to operate in the detection mode over a predetermined time after lighting circuit 1 starts operating, and outputs a signal for lighting circuit 1 to operate in the lighting mode after the predetermined time elapses. Specifically, timer circuit 134 outputs a HIGH signal over a predetermined time after AC power supply 3 starts applying AC voltage to lighting circuit 1, and outputs a LOW signal after the predetermined time elapses. Timer circuit 134 outputs the signals to oscillator circuit 133, hold circuit 135, and NOT circuit 136 via, node N13. Note that the above predetermined time is not particularly limited as long as it is long enough for voltage detector circuit 15 to detect voltage.

Oscillator circuit 133 is a signal generator for determining a signal output timing for driver circuit 132. Oscillator circuit 133 outputs an AC signal to driver circuit 132 when lighting circuit 1 is in the detection mode, that is, when receiving a HIGH signal from timer circuit 134.

Driver circuit 132 performs control of causing switching elements 122 and 123 to repeat turning ON and OFF (i.e., perform a switching operation) when lighting circuit 1 is in the detection mode. With driver circuit 132 causing switching elements 122 and 123 to repeat turning ON and OFF at the same time, power supplier 11 supplies a constant forward current to diode 23 (that is, applies a reverse bias voltage to LED 21). Driver circuit 132 receives an AC signal from oscillator circuit 133 and causes switching elements 122 and 123 to perform a switching operation in synchronization with the cycle of the AC signal.

Hold circuit 135 maintains voltage output from voltage detector circuit 15 when hold circuit 135 receives a HIGH signal from timer circuit 134. Hold circuit 135 outputs the output voltage to an inverting input terminal of comparator 137.

Comparator 137 is a circuit that compares reference voltage V0 and voltage output; from voltage detector circuit 15. When the output voltage is higher than reference voltage V0 which is a predetermined threshold value, comparator 137 outputs a LOW signal. On the other hand, when the output voltage is lower than reference voltage V0, comparator 137 outputs a HIGH signal. Furthermore, comparator 137 outputs an output signal to buffer circuit 141 of IC 14. For example, when LED module 2 includes either diode 23 having a forward voltage of approximately 0.6 V or diode 23A having a forward voltage of approximately 1.8 V, it is sufficient that reference voltage V0 is set to about an intermediate value between the above two forward voltages, that is, approximately 1.2 V.

IC 14 is a circuit that switches, according to an output signal of comparator 137, voltage that is output to an inverting input terminal of comparator 130. The output voltage corresponds to a target value of current that is output from power supplier 11 to LED module 2. IC 14 includes buffer circuit; 141 and changeover switch 142.

Buffer circuit 141 is for shaping a waveform of an output signal of comparator 137.

Changeover switch 142 is an element that connects an output terminal and terminal 143 or 144 of IC 14. Changeover switch 142 connects the output terminal and terminal 144 of IC 14 when a HIGH signal is input thereto, and connects the output terminal and terminal 143 of IC 14 when a LOW signal is input thereto. Reference voltages V1 and V2 different from each other are applied to terminals 144 and 143, respectively. Reference voltages V1 and V2 correspond to a first current value and a second current value, respectively, which are target values of the output current of power supplier 11. Specifically, when the voltage that is detected by voltage detection circuit 15 is lower than reference voltage V0 which is a predetermined, threshold value, control circuit 13 sets the target value of the output current of power supplier 11 to the first current value. On the other hand, when the voltage that is detected by voltage detection circuit 15 is higher than reference voltage V0 which is a predetermined threshold value, control circuit 13 sets the target value of the output current of power supplier 11 to the second current value.

Comparator 130 is a circuit that compares voltage corresponding to current output from power supplier 11 and reference voltage V1 or V2 corresponding to the target value of the current. Output of driver circuit 131 is controlled based on an output signal of comparator 130 to allow feedback control so that the output current of power supplier 11 approaches the target value. Voltage at node N5, that is, voltage that is applied to resistor 113, is input to a non-inverting input terminal of comparator 130. Reference voltage V1 or V2 which is output of IC 14 is input to an inverting input terminal of comparator 130.

NOT circuit 136 inverts a signal received from timer circuit 134 and outputs the signal to driver circuit 131.

Driver circuit 131 performs control of causing switching elements 121 and 124 to repeat turning ON and OFF (i.e., perform a switching operation) when lighting circuit 1 is in the lighting mode. With driver circuit 131 causing switching elements 121 and 124 to repeat turning ON and OFF at the same time, power supplier 11 supplies a constant forward current to LED 21. Furthermore, driver circuit 131 receives, from NOT circuit 136, a signal resulting from inverting the output signal of timer circuit 134, and determines, based on the signal, whether the current mode is the lighting mode. In this embodiment, the current mode is determined as the lighting mode when the signal is a HIGH signal, and is determined as the detection mode when the signal is a LOW signal. Furthermore, driver circuit 131 receives a signal from comparator 130. When driver circuit 131 receives a HIGH signal from comparator 130, that is, when current that is output from power supplier 11 is greater than the target value of the current, driver circuit 131 outputs a HIGH signal having a reduced pulse width to switching elements 121 and 124. With this, driver circuit 131 reduces the output current of power supplier 11. On the other hand, when driver circuit 131 receives a LOW signal from comparator 130, that is, when current that is output from power supplier 11 is less than the target value of the current, driver circuit 131 outputs a HIGH signal having an increased pulse width to switching elements 121 and 124. With this, driver circuit 131 increases the output current of power supplier 11. Thus, control circuit 13 performs such feedback control that the output current of power supplier 11 approaches the target value.

With the above-described configuration, lighting circuit 1 is capable of identifying electrical characteristics of LED module 2 according to a forward voltage of diode 23 of LED module 2 and supplying an output current adapted to the electrical characteristics. Specifically, control circuit 13 detects a forward voltage of diode 23 by detecting voltage that is applied between first input terminal 221 and second input terminal 222 of LED module 2. When the forward voltage is lower than a predetermined, threshold voltage, control circuit 13 controls power supplier 11 in such a way that current that is supplied in a forward direction to LED 21 is of a first current value. On the other hand, when the forward voltage is higher than the threshold value, control circuit 13 controls power supplier 11 in such a way that the current is of a second current value different from the first current value.

1-3. Operation Performed by Lighting Circuit

Next, an operation performed by lighting circuit 1 according to this embodiment is described with reference to the drawings.

Figure 5:
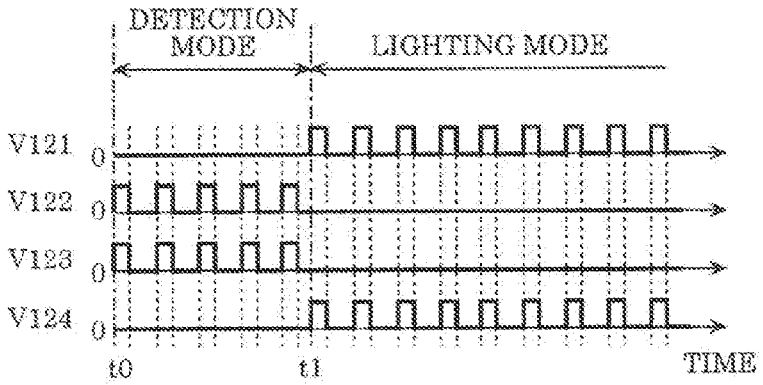
FIG. 5 is a graph showing time waveforms of signals input to switching elements of a lighting circuit according to Embodiment 1.

FIG. 5 is a graph showing time waveforms of signals input to switching elements of lighting circuit 1 according to this embodiment. In FIG. 5, time waveforms of voltages V121, V122, V123, and V124 of the signals that are input to respective gate electrodes of switching elements 121, 122, 123, and 124 are shown.

First, at time point t0 in FIG. 5, AC power supply 3 applies AC voltage to lighting circuit 1, and timer circuit 134 then starts counting time and outputs, to NOT circuit 136, oscillator circuit 133, and hold circuit 135, HIGH signals indicating that the current mode is the detection mode.

When oscillator circuit 133 receives the HIGH signal from timer circuit 134, oscillator circuit 133 outputs an AC signal to driver circuit 132.

When driver circuit 132 receives the AC signal from oscillator circuit 133, driver circuit 132 repeatedly outputs a HIGH voltage signal pulse to the respective gate electrodes of switching elements 122 and 123 in synchronization with the AC signal as shown in FIG. 5. The width of the pulse is a parameter that determines current which lighting circuit 1 outputs in the detection mode. In this embodiment, the current which lighting circuit 1 outputs increases as the width of the pulse increases. The width of the pulse is determined based on characteristics, etc., of diode 23 and LED 21 in such a way that diode 23 and LED 21 are not damaged.

Input of the HIGH signal to the gate electrodes of switching elements 122 and 123 causes switching elements 122 and 123 to turn ON. In this case, current flows along the path from AC power supply 3 sequentially to rectifier 111, switching element 123, diode 23, inductor 114, switching element 122, resistor 113, rectifier 111, and AC power supply 3, and a forward voltage is applied across diode 23. Note that in this case, voltage is applied to LED 21 in a reverse direction (that is, a reverse bias voltage is applied thereto), and therefore no current flows to LED 21.

In the state where the forward voltage is applied across diode 23, voltage detector circuit 15 detects the forward voltage and outputs, to hold circuit 135, voltage corresponding to the forward voltage.

When hold circuit 135 receives the HIGH signal from timer circuit 134, hold circuit 135 maintains the voltage output from voltage detector circuit 15 that corresponds to the forward voltage of diode 23, and outputs the voltage to the inverting input terminal of comparator 137.

Comparator 137 compares the voltage received from hold circuit 135 and reference voltage V0 corresponding to the predetermined threshold value. When the voltage received from hold circuit 135 that corresponds to the forward voltage of diode 23 is lower than reference voltage V0, comparator 137 outputs a HIGH signal to IC 14. When the voltage received from hold circuit 135 that corresponds to the forward voltage of diode 23 is higher than reference voltage V0, comparator 137 outputs a LOW signal to IC 14.

When IC 14 receives the HIGH signal from comparator 137, that is, when the forward voltage of diode 23 is lower than the predetermined threshold value, IC 14 outputs, to the inverting input terminal of comparator 130, reference voltage V1 which corresponds to the first current value. When IC 14 receives the LOW signal from comparator 137, that is, when the forward voltage of diode 23 is higher than the predetermined threshold value, IC 14 outputs, to the inverting input terminal of comparator 130, reference voltage V2 which corresponds to the second current value.

Note that when timer circuit 134 outputs a HIGH signal indicating that the current mode is the detection mode, driver circuit 131 receives a LOW signal from NOT circuit 136. With this, driver circuit 131 keeps outputting LOW voltage signals to the gate electrodes of switching elements 121 and 124 as shown in FIG. 5.

As described above, lighting circuit 1 identifies electrical characteristics of LED module 2 by detecting a forward voltage of diode 23 (that is, voltage that is applied between first output terminal 101 and second output terminal 102) in the detection mode. Furthermore, lighting circuit 1 determines a target value of the output current to be the first current value or the second current value so that the output current is adapted to the electrical characteristics of LED module 2.

Subsequently, on and after time point t1 in FIG. 5, timer circuit 134 outputs, to NOT circuit 136, oscillator circuit 133, and hold circuit 135, a LOW signal indicating that the current mode is the lighting mode.

When NOT circuit 136 receives the LOW signal from timer circuit 134, NOT circuit 136 outputs a HIGH signal to driver circuit 131.

When driver circuit 131 receives the HIGH signal from NOT circuit 136, driver circuit 131 repeatedly outputs a HIGH voltage signal pulse to the respective gate electrodes of switching elements 121 and 124 as shown in FIG. 5. The width of the pulse is a parameter that determines current that is output from lighting circuit 1 in the lighting mode. In this embodiment, the current which lighting circuit 1 outputs increases as the width of the pulse increases. The width of the pulse is controlled according to a signal that is input from comparator 130 to driver circuit 131.

Input of the HIGH signal to the gate electrodes of switching elements 121 and 124 causes switching elements 121 and 124 to turn ON. In this case, current flows along the path from AC power supply 3 sequentially to rectifier 111, switching element 121, inductor 114, LED 21, switching element 124, resistor 113, rectifier 111, and AC power supply 3, and LED 21 is turned ON. Note that in this case, voltage is applied to diode 23 in a reverse direction (that is, a reverse bias voltage is applied thereto). Therefore, no current flows to diode 23.

As described above, in order to turn LED 21 ON, voltage that is applied to resistor 113 is input to the non-inverting input terminal of comparator 130, and compared therein with reference voltage V1 or reference voltage V2 which corresponds to a target value of the output current of power supplier 11, that is, the first current value or the second current value. When the voltage that is applied to resistor 113 is higher than the reference voltage, that is, when the output current of power supplier 11 is greater than the target value, comparator 130 outputs a HIGH signal to driver circuit 131. When driver circuit 131 receives the HIGH signal from comparator 130, driver circuit 131 outputs a HIGH signal having a reduced pulse width to switching elements 121 and 124, thereby reducing the output current of power supplier 11. On the other hand, when current that is applied to resistor 113 is lower than the reference voltage, that is, when the output current of power supplier 11 is less than the target value, comparator 130 outputs a LOW signal to driver circuit 131. When driver circuit 131 receives the LOW signal from comparator 130, driver circuit 131 outputs a HIGH signal having an increased pulse width to switching elements 121 and 124, thereby increasing the output current of power supplier 11. Thus, control circuit 13 performs such feedback control that the output current of power supplier 11 approaches the target value.

By operating as described above, lighting circuit 1 is capable of identifying electrical characteristics of LED module 2 according to a forward voltage of diode 23 of LED module 2, and supplying an output current adapted to the electrical characteristics.

1-4. Advantageous Effects, etc.

As described above, lighting circuit 1 according to this embodiment supplies current to LED module 2. LED module 2 includes: LED 21; first input terminal 221 connected to one end of LED 21; second input terminal 222 connected to the other end of LED 21; and diode 23 connected in inverse-parallel connection with LED 21 between first input terminal 221 and second input terminal 222. Lighting circuit 1 includes power supplier 11 which supplies current between first input terminal 221 and second input terminal 222 of LED module 2 selectively in one of the forward direction and the reverse direction of LED 21. In addition, lighting circuit 1 further includes voltage detector circuit 15 which detects voltage that is applied between first input terminal 221 and second input terminal 222 when power supplier 11 supplies current in the reverse direction of LED 21, between first input terminal 221 and second input terminal 222. Moreover, lighting circuit 1 further includes control circuit 13 which controls, based on the result of the detection by voltage detector circuit 15, supply of current from power supplier 11 to LED module 2.

With this, lighting circuit 1 is capable of identifying electrical characteristics of LED module 2 by detecting a forward voltage of diode 23 that corresponds to the electrical characteristics. Thus, lighting circuit 1 is capable of supplying current adapted to LED module 2. Furthermore, since LED module 2 has a configuration in which diode 23 is connected in inverse-parallel connection with LED 21, no current flows to diode 23 when LED module 2 is ON. Accordingly, the power loss at diode 23 can be reduced.

This means that lighting circuit 1 according to this embodiment has high efficiency. Furthermore, in lighting circuit 1, there is no need to provide a separate terminal for detecting electrical characteristics of LED module 2, and therefore it is possible to simplify the circuit configuration.

Furthermore, in lighting circuit 1, power supplier 11 includes four switching elements 121, 122, 123, and 124 which form a full-bridge circuit.

With this, lighting circuit 1 is capable of supplying current in the forward and reverse directions of LED 21 by use of a single circuit. Thus, it is possible to simplify the circuit configuration of lighting circuit 1.

Furthermore, in lighting circuit 1, control circuit 13 controls power supplier 11 in such a way that current that is supplied in the forward direction to LED 21 is of the first current value when the voltage detected by voltage detector circuit 15 is lower than a predetermined threshold value. On the other hand, when the voltage is higher than the threshold value, control circuit 13 controls power supplier 11 in such a way that the current is of the second current value different from the first current value.

With this, lighting circuit 1 is capable of switching current that is supplied to LED module 2 between two different current values according to the electrical characteristics of LED module 2.

Furthermore, illumination system 10 according to this embodiment includes lighting circuit 1 and LED module 2.

This allows illumination system 10 to produce the same or similar effects as those produced by lighting circuit 1. For a configuration of LED module 2 included in illumination system 10, it is possible to adopt a relatively simple configuration in which diode 23 is connected in inverse-parallel connection with LED 21.

Embodiment 2

Next, a configuration of an illumination system according to Embodiment 2 is described. The illumination system according to this embodiment adopts, as a light source to be included in the LED module, light source 20B illustrated in FIG. 3B. The illumination system according to this embodiment includes a lighting circuit adapted to the LED module, and therefore is capable of continuously changing a preset value of current that is supplied to the LED module.

The following description will focus on the configuration of the illumination system according to this embodiment that is different from that of illumination system 10 according to Embodiment 1 described above; as such, description of configurations common to these embodiments will be omitted.

2-1. Configuration of Lighting Circuit

First, a configuration of a lighting circuit and a configuration of an illumination system including the lighting circuit according to this embodiment are described with reference to the drawings.

Figure 6:
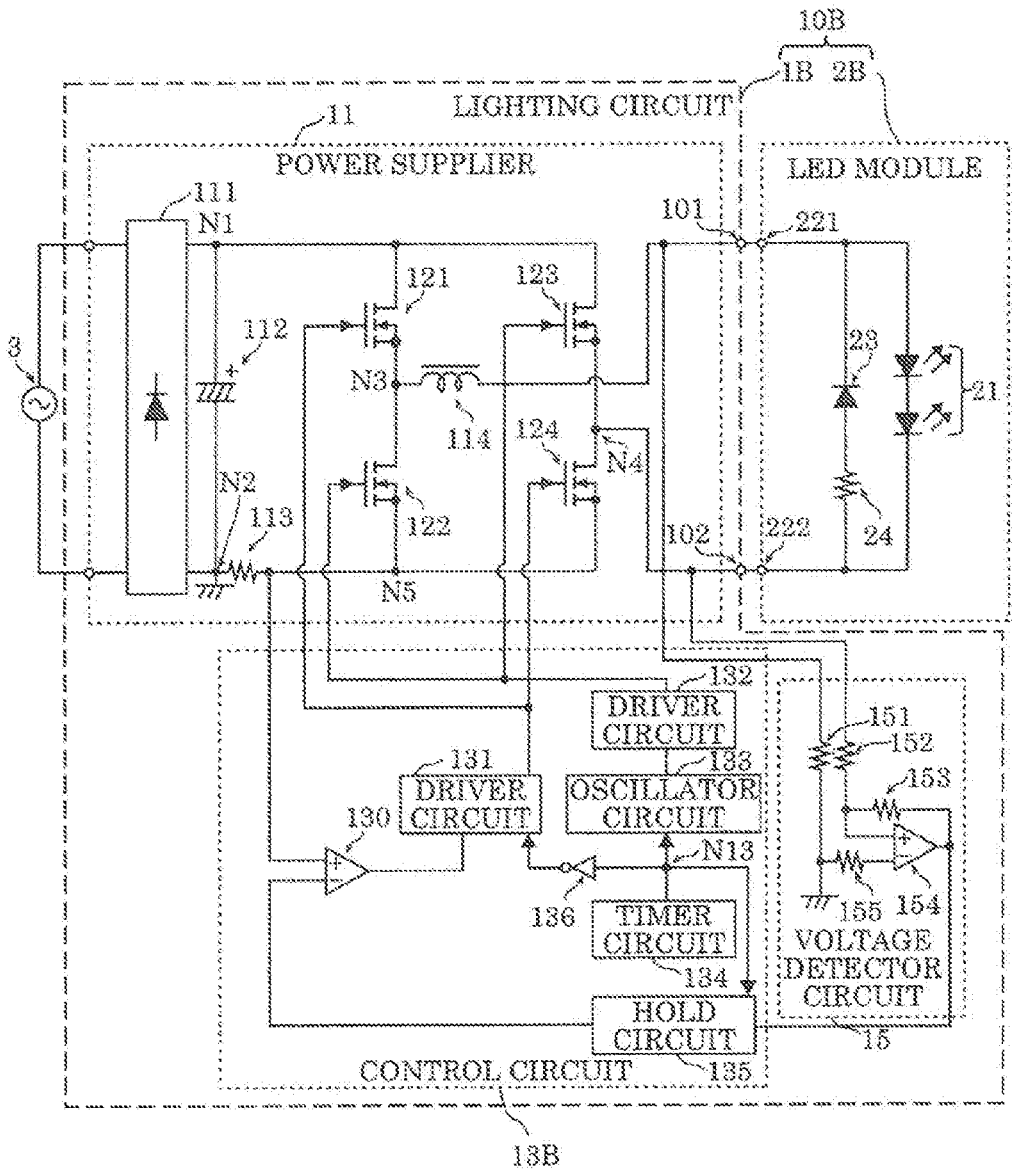
FIG. 6 is a circuit diagram illustrating a configuration of a lighting circuit according to Embodiment 2.

FIG. 6 is a circuit diagram illustrating a configuration of lighting circuit 1B according to this embodiment. FIG. 6 illustrates lighting circuit 1B, illumination system 10B including lighting circuit 1B, and AC power supply 3 which supplies AC voltage to lighting circuit 1B.

As illustrated in FIG. 6, illumination system 10B includes lighting circuit 1B and LED module 2B.

LED module 2B is a solid-state light-emitting element module including light source 20B illustrated in FIG. 3B. In LED module 2B, diode 23 is connected in inverse-parallel connection with LED 21, and resistor 24 is connected in series with diode 23.

Lighting circuit 1B supplies current to LED module 2B and includes power supplier 11, control circuit 13B, and voltage detector circuit 15. Furthermore, lighting circuit 1B includes first output terminal 101 and second output terminal 102. When compared to lighting circuit 1 according to Embodiment 1 described above, lighting circuit 1B is different in terms of the configuration of control circuit 13B, but is the same in the other configurations. A configuration of control circuit 13B which is a difference between lighting circuit 1B and lighting circuit 1 is described below.

As with control circuit 13 according to Embodiment 1 described above, control circuit 13B controls, based on the result of the detection by voltage detector circuit 15, supply of current from power supplier 11 to LED module 2B. Control circuit 13B includes comparator 130, driver circuits 131 and 132, oscillator circuit 133, timer circuit 134, hold circuit 135, and NOT circuit 136, as does control circuit 13. Control circuit 13B is different from control circuit 13 in that comparator 137 and IC 14 are not provided and that the output voltage of hold circuit 135 is directly input to comparator 130.

With a configuration such as that described above, control circuit 13B inputs to comparator 130 voltage corresponding to voltage that is applied between first output terminal 101 and second output terminal 102. The voltage corresponding to voltage that is applied between first output terminal 101 and second output terminal 102 is equivalent to a sum of voltage that is applied to diode 23 and voltage that is applied to resistor 24. Thus, in this embodiment, voltage corresponding to the sum of these voltages is input to the inverting input terminal of comparator 130 as a value corresponding to a target value of the output current of power supplier 11. With this, lighting circuit 1 according to this embodiment is capable of continuously changing the target value of the output current according to the forward voltage of diode 23 and the resistance value of resistor 24. For example, it is possible to continuously change the target value of the output current by continuously changing the resistance value of resistor 24 in this embodiment, the target value of the output current of lighting circuit 1B has a positive correlation with the voltage that is applied between first output terminal 101 and second output terminal 102. Therefore, it is sufficient, for example, to increase the resistance value of resistor 24 as current to be supplied to LED module 2 increases. In order to set the target value of the output current to a desired value, the resistance values of resistors 152 and 153 of voltage detector circuit 15 may be set as appropriate.

2-2. Advantageous Effects, etc.

As described above, in lighting circuit 1B according to this embodiment, control circuit 13B continuously changes, according to the voltage detected by voltage detector circuit 15, the value of current that is supplied in the forward direction to LED 21.

With this, lighting circuit 1B is capable of changing the output current according to LED module 2B and therefore is capable of supplying current to LED module 2B that has various electrical characteristics.

Illumination system 10B according to this embodiment includes lighting circuit 1B and LED module 2B, and further includes resistor 24 which is connected in series with diode 23.

This allows illumination system 10B to produce the same or similar effects as those produced by lighting circuit 1B.

Embodiment 3

Figure 7:
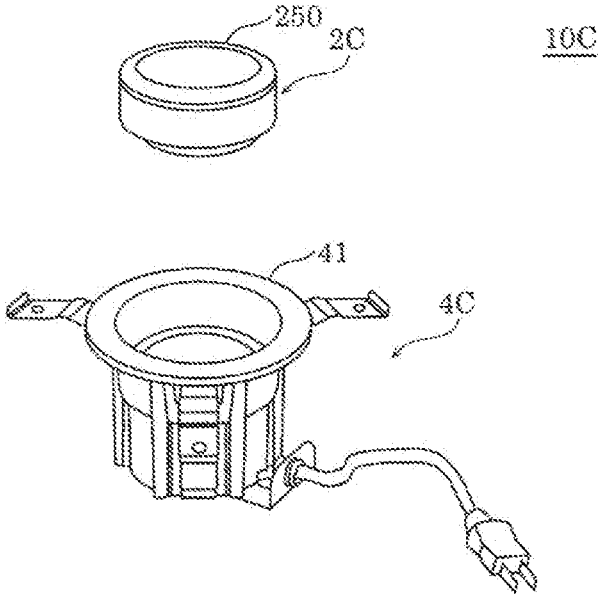
FIG. 7 is an external view of an illumination system according to Embodiment 3.

Next, an illumination system according to Embodiment 3 is described. FIG. 7 is an external view of illumination system 10C according to this embodiment. Illumination system 10C illustrated in FIG. 7 includes luminaire 4C and LED module 2C. Luminaire 4C includes one of lighting circuits 1 and 1B according to the above embodiments and socket 6 (not illustrated in the drawings) for connecting LED module 2C. In this embodiment, luminaire 4C is a downlight, and includes lamp mount 41 which houses the lighting circuit and to which LED module 2C is fitted. LED module 2C includes the same or similar circuit as that included in LED module 2 or 2B, and includes housing 250 having, on an external surface, plug 22 for connecting to socket 6 of luminaire 4C.

Since such illumination system 10C includes one of lighting circuits 1 and 1B and one of LED modules 2 and 2B according to the above embodiments, illumination system 10C is capable of producing the same or similar advantageous effects as those produced by one of illumination systems 10 and 10B according to the above embodiments.

Variations and Others

Although the lighting circuit and the illumination system according to the embodiments have been described above, the present disclosure is not limited to these embodiments.

For example, although LED 21 is formed of an SMD LED element in the above embodiments, this is not the only example. For example, an LED chip mounted on a substrate per se may be adopted as LED 21.

Furthermore, although LEI) 21 is used as a solid-state light-emitting element in the above embodiments, other solid-state light-emitting elements such as an organic EL (electroluminescence) element may be used.

Furthermore, although diode 23 or 23A is used as a rectifying element in the above embodiments, the rectifying element is not limited to diode 23 or 23A. It is sufficient that the rectifying element is an element that exhibits rectifying behavior Furthermore, although power supplier 11 includes four switching elements that form a full-bridge circuit, the configuration of power supplier 11 is not limited to this example. Power supplier 11 can be any power supply that can control the direction and value of current that is to be output.

Furthermore, although one threshold value is used in Embodiment 1 described above, a plurality of threshold, values may be provided to set three or more target values of current.

Furthermore, although the target value of the output current of lighting circuit 1B has a positive correlation with voltage that is applied between first output terminal 101 and second output terminal 102 in Embodiment 2 described above, the relationship between the target value and the voltage is not limited to this example. For example, it is possible to provide a lighting circuit in which the target value has a negative correlation with the voltage by inserting an inverse proportion operational circuit between hold circuit 135 and comparator 130 in lighting circuit 1B.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting circuit which supplies current to a solid-state light-emitting element module including: a solid-state light-emitting element; a first input terminal connected to one end of the solid-state light-emitting element; a second input terminal connected to another end of the solid-state light-emitting element; and a rectifying element connected in inverse-parallel connection with the solid-state light-emitting element between the first input terminal and the second input terminal, the lighting circuit comprising:

a power supplier that supplies current between the first input terminal and the second input terminal of the solid-state light-emitting element module selectively in one of a forward direction and a reverse direction of the solid-state light-emitting element;

a voltage detector circuit that measures a voltage amount including voltage of the rectifying element connected in inverse-parallel connection with the solid-state light-emitting element between the first input terminal and the second input terminal, when the power supplier supplies current between the first input terminal and the second input terminal in the reverse direction of the solid-state light-emitting element; and a control circuit that controls, based on a result of the measurement by the voltage detector circuit, supply of current from the power supplier to the solid-state light-emitting element module.

2. The lighting circuit according to claim 1, wherein the power supplier includes four switching elements that form a full-bridge circuit.

3. The lighting circuit according to claim 1, wherein the control circuit causes the power supplier to (i) supply current of a first current value in the forward direction to the solid-state light-emitting element when the voltage amount is lower than a predetermined threshold value, and (ii) supply current of a second current value in the forward direction to the solid-state light-emitting element when the voltage amount is higher than the predetermined threshold value, the second current value being different from the first current value.

4. The lighting circuit according to claim 1, wherein the control circuit continuously changes, according to the voltage amount, a value of current that is supplied in the forward direction to the solid-state light-emitting element.

5. An illumination system comprising:

the lighting circuit according to claim 1; and the solid-state light-emitting element module.

6. The illumination system according to claim 5, wherein the solid-state light-emitting element module further includes a resistor connected in series with the rectifying element.

* * * * *